US006138301A

United States Patent [19]

Battiston

[11] Patent Number: 6,138,301

[45] Date of Patent: Oct. 31, 2000

[54] BED TRANSFER DEVICE

[75] Inventor: Joseph Battiston, Chester, Va.

[73] Assignee: Tubular Fabricators Industry, Petersburg, Va.

[21] Appl. No.: 09/273,374

[22] Filed: Mar. 22, 1999

[51] Int. Cl.[7] ..... A61G 7/053

[52] U.S. Cl. ..... 5/81.1 R; 5/662; 5/659

[58] Field of Search ..... 5/81.1 R, 503.1, 5/658, 659, 662, 426

[56] References Cited

U.S. PATENT DOCUMENTS

| | | | |
|---|---|---|---|
| 1,797,847 | 3/1931 | Vandagriff . | |
| 2,555,228 | 5/1951 | Evers . | |
| 2,593,567 | 9/1952 | Keck . | |
| 2,712,137 | 7/1955 | Hunter . | |
| 2,722,693 | 11/1955 | Wolf . | |
| 2,751,608 | 6/1956 | Lucas . | |
| 2,929,078 | 3/1960 | Smith . | |
| 3,176,322 | 4/1965 | Mulcahy | 5/503.1 |
| 3,474,473 | 10/1969 | Hannaberg . | |
| 3,863,282 | 2/1975 | Stillwell . | |
| 4,104,751 | 8/1978 | Churchman . | |
| 4,334,330 | 6/1982 | Marshall . | |
| 4,561,549 | 12/1985 | Yokohori . | |
| 4,836,523 | 6/1989 | Englander . | |
| 4,932,090 | 6/1990 | Johansson . | |
| 5,121,516 | 6/1992 | Jones . | |
| 5,195,200 | 3/1993 | Leoutsakos . | |
| 5,231,721 | 8/1993 | Fish . | |
| 5,257,426 | 11/1993 | Leoutsakos . | |
| 5,394,581 | 3/1995 | Leoutsakos . | |
| 5,400,450 | 3/1995 | Leoutsakos . | |
| 5,463,784 | 11/1995 | Alpern | 5/662 X |
| 5,471,689 | 12/1995 | Shaw et al. | 5/662 |
| 5,787,530 | 8/1998 | Brix . | |

FOREIGN PATENT DOCUMENTS

| | | |
|---|---|---|
| 1006956 | 10/1965 | United Kingdom . |
| WO82/02832 | 9/1982 | WIPO . |

*Primary Examiner*—Michael F. Trettel
*Attorney, Agent, or Firm*—Klauber & Jackson

[57] ABSTRACT

A bed transfer device for use by individuals in getting into and out of bed. The device includes a rail member and a lateral support member of generally the same shape and size. The lateral support member slides between the mattress and box spring. The rail member supported by the floor and the lateral support member allows for an individual to grasp the rail when transferring from bed.

15 Claims, 4 Drawing Sheets

BED TRANSFER DEVICE

BACKGROUND OF THE INVENTION

A. Field of the Invention

The present invention relates to a bed transfer device and more particularly to bed transfer devices adapted for use with conventional beds.

B. Description of the Related Art

In certain instances it has been known that individuals may need assistance getting into and out-of bed. In some instances where an individual has been injured, the need may be temporary. In other cases, where the individual is elderly or suffers from a permanent disability, the problem may be persistent. Often times the individual may be living alone or have access to limited financial assistance when the need arises for some additional help in transferring to and from the bed. Many times the individual may have a limited income or the problem may persist for such a short period time that limited funds are available for such a need.

Expensive and elaborate bed transfer systems, such as hospital beds with bed rails formed integrally therewith, have been available for some time; however, such systems are cost prohibitive for home-care use. Other bed transfer systems have been developed for home care use which utilize a wooden board or other rigid, sheet-like material for insertion between the box spring and mattress of a conventional bed to which a transfer rail is attached thereto. Such systems, while adequate for there intended purpose, may be difficult for the elderly or persons with injuries to install and remove. By providing a rigid layer between the bed and the box spring, such systems inherently interfere with the comfort level achieved by the cooperation of the mattress with the box spring. Such a barrier may not always be desirable. Thus, the need exists for a low cost and easy-to-use bed transfer device that provides a both long and short term solutions for individuals when transferring into or out of bed.

OBJECTS AND SUMMARY OF THE INVENTION

It is an object of the present invention to provide a bed transfer device that is low in cost and simplifies manufacturing steps.

It is a further object of the present invention to provide a bed transfer device that is adaptable for a variety of beds and users.

It is an advantage of the present invention in using a tubular looped lateral support member that the device has a minimal impact on the bed firmness provided by the cooperation of the box spring and mattress.

It is a further advantage of the present invention that the apparatus may be disassembled when not in use.

It is a feature of the present invention that the lateral support member and the rail are manufactured of the same size and shape to reduce manufacturing costs.

It is another feature of the present invention that the adjustment of the bed transfer device to conform to a bed is independent of the adjustment of the bed transfer device for a user.

The present invention is embodied in a bed transfer device including a first tubular member having ends that are each connected to a pair of collars, each with a cylindrical outer surface defining a hollow center. A second tubular member having ends is slidably received through the hollow center of the collars. A fastener, associated with each of the collars, is adapted to maintain the second tubular in a stationary and moveable relationship with respect to each of the collars. Floor supports are adjustably coupled to the ends of the second tubular member. When in use, the first tubular member is removably inserted between the surface layers of the bed and the second tubular member is adjusted to extend from the floor supports to a height adjusted by the user.

It will be appreciated that adjustment of the first tubular member relative to the second tubular member may be accomplished independently of the height adjustment of the second tubular member.

In a further aspect of the present invention, the first and second tubular members are generally of the same size and shape.

The present invention can be more fully understood by reference to the following description and accompanying drawings, which form an integral part of this application:

BRIEF DESCRIPTION OF THE DRAWING(S)

DETAILED DESCRIPTION OF THE PREFERRED EMBODIMENT(S)

Figure 1:
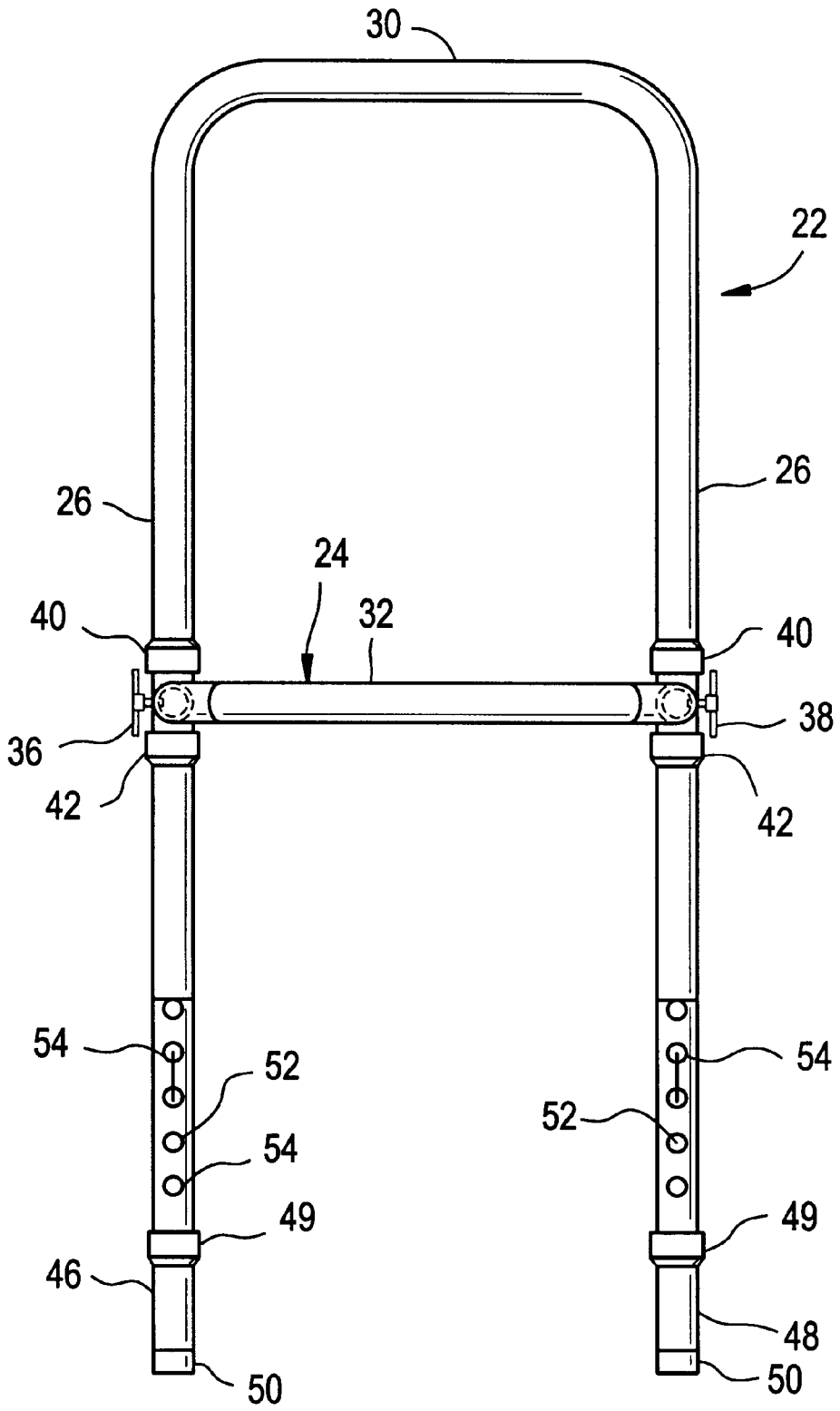
FIG. 1 is front view of the present invention.
Figure 2:
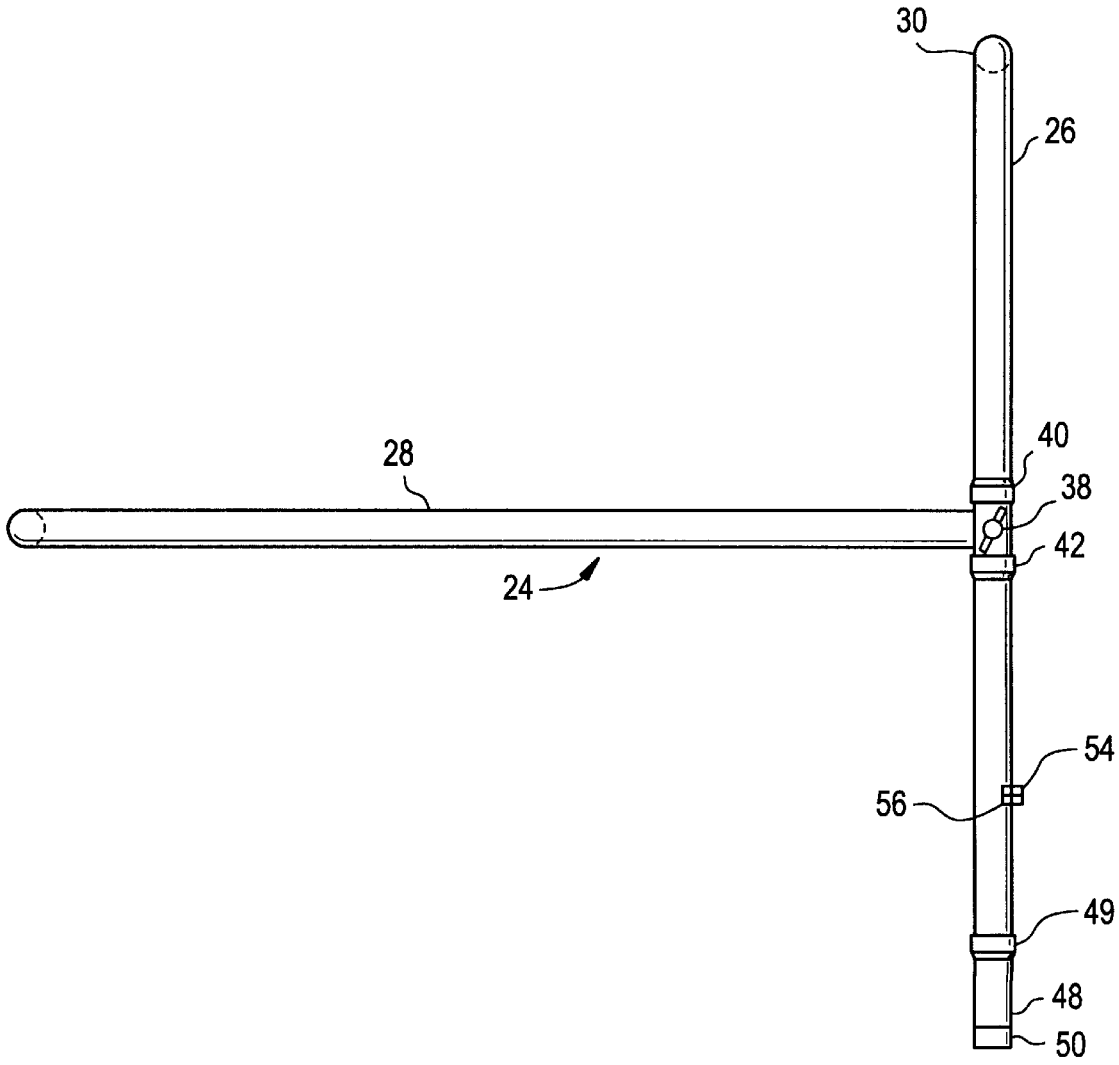
FIG. 2 is side view of the present invention.
Figure 3:
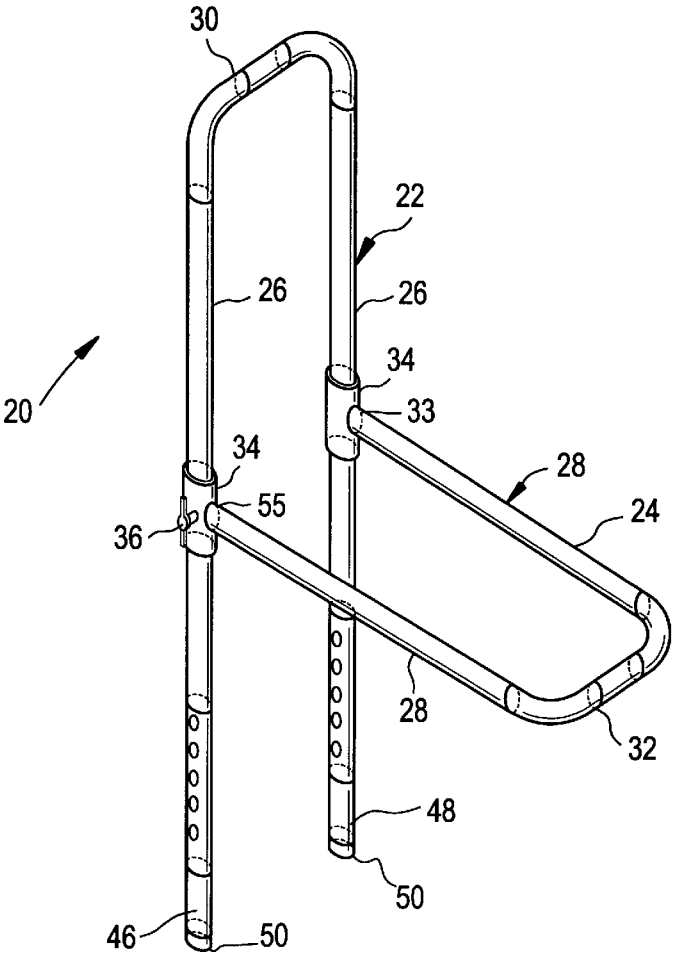
FIG. 3 is perspective view of the present invention.
Figure 4:
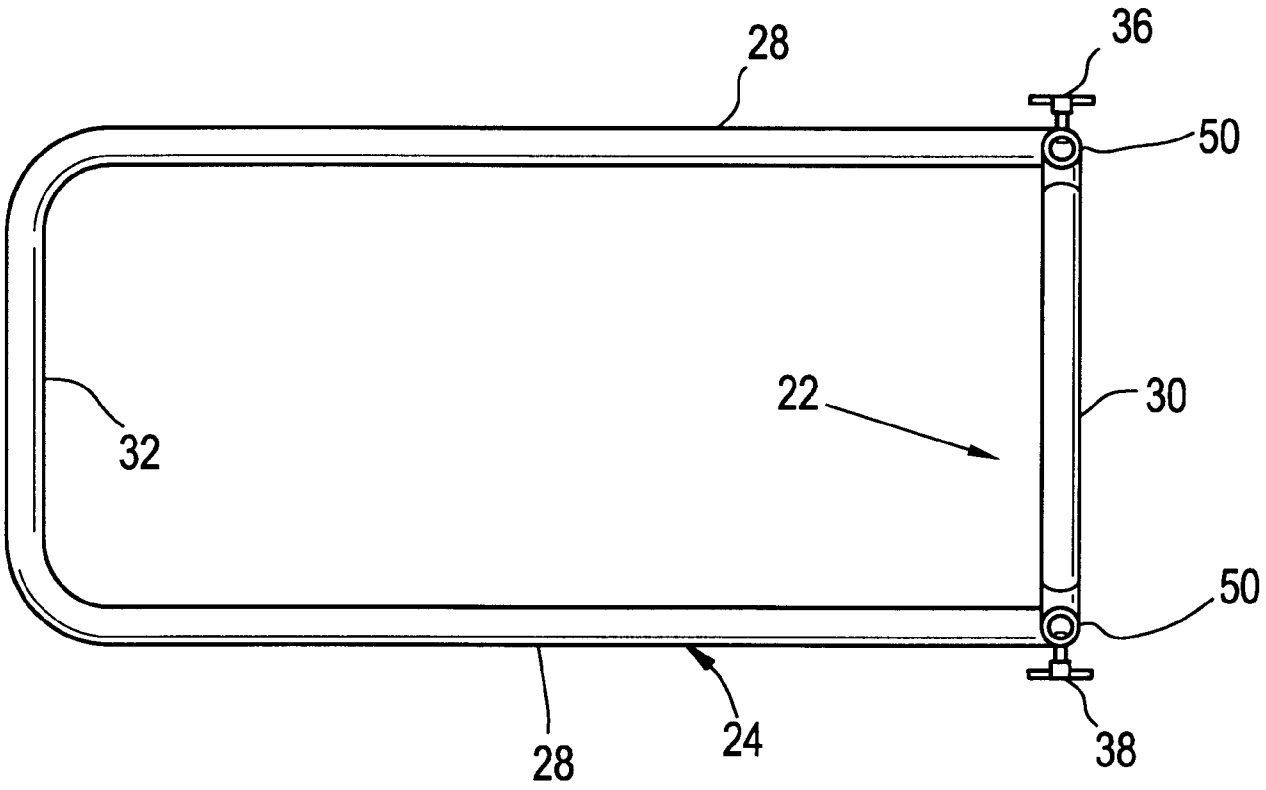
FIG. 4 is bottom view of the present invention.

With reference to FIGS. 1–4, the bed transfer device 20 of the present invention includes generally a height adjustable rail or support member 22 is adjustably coupled to a lateral support member 24 which extends into a bed between the mattress and box spring (FIG. 2). Advantageously, the adjustment of the lateral support member 24 relative to the rail member 22 is independent of the height adjustment of the rail member 22.

Furthermore, the rail member 22 and lateral support member 24 are generally of the same size and shape allowing for their manufacture from the same tooling and assembly line. In this way, the cost for manufacture is significantly reduced. The lateral support member 24 and rail member 22 are each formed of a generally U-shaped tubular frame. The diameter of the tubes is preferably generally one inch; however a good diameter range is 0.5 to 2 inches and a workable diameter range is any suitable for providing support to an individual getting out of bed while minimizing displacement of the mattress from the box spring. It is understood that one embodiment of the present invention may include tubes of differing diameters. Furthermore, such considerations as discussed above may be achieved with smaller diameters, where the tubular members are made of a solid bar rather than a hollow tube. The tubes are configured with two legs 26 and 28 of generally equal length with a cross-member 30 and 32 having a length sufficient to provide lateral support. The length of the tube legs may vary according to bed size and user height requirements, however, it is desireable that the legs for the lateral tubes remain less than the width of the mattress. In general, the length of the legs 26 should be sufficient to allow for the cross-member 30 of the rail member to suspended above the bed at a height convenient for a person to transfer to and from the bed. The cross-member 30 and 32 of the rail member and the lateral member may be coated with valucanized rubber or the like. The rubber may improve gripping of the rail 22 and would help to resist withdrawal of the lateral support member 24 from between the mattress and box spring.

The free ends 33 of the lateral support or first tubular member 24 are connected to a pair of collars 34. The connection may be achieved by welding or by any other conventional means for connecting the lateral support member to the collars. The collars 34 include cylindrical apertures through which the legs 26 of the rail or second tubular member 22 are slidingly received there through. The collars 34 may be freely moved along the length of the rail member legs 26 to adjust the height of the lateral support member 24 for insertion between the mattress and box spring. It will be appreciated that the collars 34 are generally formed with a longitudinal length and aperture relative to the diameter of the rail member 22 to assist with sliding of the collars 34 uniformly and together. Providing a longitudinal length of the collar that is too short or an aperture diameter relative the rail member that is too wide may cause the collars 34 slide unevenly relative to each other. A collar having a longitudinal length and diameter suitable, but not limited to, maintain alignment of the collars 34 when sliding is preferred. Sliding of the collars 34 and lateral support member 24 are further assisted when using connection means such as welding which ensures the fixed alignment of the collars 34 relative to each other and the lateral member. It is believed that these features increase the ease by which height adjustments may be made.

The collars 34 are equipped with fasteners 36 and 38 which permit the collars 34 to locked against the rail member legs 26. In the preferred embodiment the fasteners 36 and 38 are preferably wing nuts which threadably screw into the collars 34 for a conventional friction fit engagement against the rail member 22. It will be appreciated that any number of similar fasteners may used to secure the collars 34 with the rail member 22. Other types of fasteners may include screws, compression rings, push-buttons, friction grip, clevis pins, cotter pins, or conventionally available means for fastening the collars with the rail member. The collars 34 may include guard rings 40 and 42 along the upper and lower openings to guard the user against contact with the collar edge.

Nested telescopically within the ends of the rail member 22 are a pair of floor supports 46 and 48. A guard ring 49 protects the user from contact with the outer ring at the nesting point. Rubber stops 50 are located at the base of the floor supports to resist lateral movement along a floor surface. The floor supports 46 and 48 may be locked in relation to the rail member 22 by height adjustment fasteners which prevents telescopic movement of the floor supports with the rail. Preferably, the height adjustment fasteners includes a set of apertures 54 located in spaced apart relation of the rail and a spring-biased bolt 56 connected to floor support. When the bolt 56 is aligned with one of the holes 54, the bolt projects through the hole to prevent further telescopic movement. The spaced apart holes 54 in each of the rail legs allows for even height adjustment of the legs. This height adjustment configuration is preferred due to the fact that the apertures 54 may function as a graduated measurement for height adjusting each of the legs and by fixing the height adjustment locations at predetermined points, uniform alignment of the legs 26 is facilitated.

Operation:

When in use the cross-member 30 of the rail member 22 may be height adjusted relative to the floor by moving the floor supports 46 and 48 telescopically relative to the rail legs 26. Upon achieving a desired height the floor supports are locked relative to the rail member 22 by the height adjustment fastners 52. With the collars 34 movable relative to the rail member 22, the lateral support member 24 is inserted between the box spring and mattress. The lateral support member 24 is received therein until the rail member 22 is brought adjacent to the bed. Upon completing insertion of the lateral support member 24, the fasteners 36 and 38 on the collars are optionally tightened to lock the relative height of the lateral support member 24 relative to the rail member 22. In some instances where the box spring lowers substantially when the weight of a human body is applied thereto, it may be desirable to allow the collars 34 to move relative to the rail member 22. This allows for the lateral support member to move in relation to the movement of the box spring.

Upon adjusting the device, a user may use the rail member 22 for support when getting into out of bed by grasping the cross-member 30. The rail member is supported both by the floor and the lateral support member in cooperation with the bed. In this way the device can assist the user in easily getting into or out of bed.

While the invention has been described in terms of what are presently considered to be the most practical and preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. A bed transfer device for use with a bed having at least two surface layers, said bed transfer device comprising:

a first tubular member having ends;

a pair of collars, each with a outer surface defining a hollow center;

said first tubular member ends, each connected to said outer surface of said collars;

a second tubular member having ends slidably received through said hollow center of said collars;

a fastener associated with each of said collars and adapted to maintain said second tubular in a stationary and moveable relationship with respect to each of said collars; and floor supports adjustably coupled to said ends of said second tubular member;

wherein said first tubular member is removably inserted between said surface layers of said bed and said second tubular member is adjusted to extend from said floor supports to a height adjusted by the user.

2. The bed transfer device of claim 1 wherein said first and second tubular members are generally of the same size and shape.

3. The bed transfer device of claim 1 wherein said first tube has a slide resistant layer.

4. The bed transfer device of claim 1 wherein said fastener is a wing nut.

5. The bed transfer device of claim 1 wherein said floor supports include tubular segments telescopically coupled to said second tubular member ends.

6. The bed transfer device of claim 5 wherein said floor supports include slide resistant covers adapted to contact a floor.

7. The bed transfer device of claim 1 wherein said floor supports include a height adjustment mechanism adapted to secure the position of said floor supports relative to said second tubular member.

8. The bed transfer device of claim 1 wherein adjusting said second tubular member relative to said floor supports is independent adjusting said second tubular member relative to said first tubular member.

9. The bed transfer device of claim 1 wherein said second tubular member includes grip region.

10. The bed transfer device of claim 2 wherein said floor supports include tubular segments telescopically coupled to said second tubular member ends.

11. The bed transfer device of claim 10 wherein said floor supports include slide resistant covers adapted to contact a floor.

12. The bed transfer device of claim 11 wherein said floor supports include a height adjustment mechanism adapted to secure the position of said floor supports relative to said second tubular member.

13. The bed transfer device of claim 12 wherein said second tubular member includes grip region.

14. The bed transfer device of claim 13 wherein adjusting said second tubular member relative to said floor supports is independent adjusting said second tubular member relative to said first tubular member.

15. A bed transfer device for use with a bed having at least two surface layers, said bed transfer device comprising:

a first tubular member having ends;

a pair of collars, each with a cylindrical outer surface defining a hollow center;

said first tubular member ends, each connected to said cylindrical outer surface of said collars;

a second tubular member having ends slidably received through said hollow center of said collars;

a fastener associated with each of said collars and adapted to maintain said second tubular in a stationary and moveable relationship with respect to each of said collars; and floor supports adjustably coupled to said ends of said second tubular member;

wherein said first tubular member is removably inserted between said surface layers of said bed and said second tubular member is adjusted to extend from said floor supports to a height adjusted by the user.

* * * * *